United States Patent [19]

Breitenstein et al.

[11] 3,995,383

[45] Dec. 7, 1976

[54] SCRAPER BOWL WITH MOVABLE FLOOR SECTION

[75] Inventors: Richard C. Breitenstein, Solon; Bernard A. Kuhl, Hudson, both of Ohio

[73] Assignee: General Motors Corporation, Detroit, Mich.

[22] Filed: Jan. 19, 1976

[21] Appl. No.: 650,451

[52] U.S. Cl. ..... 37/126 AE; 37/8; 37/129

[51] Int. Cl.[2] ..... E02F 9/28

[58] Field of Search ..... 37/124, 126 R, 126 AE, 37/126 AB, 129 R, 8, 4, 7

[56] References Cited

UNITED STATES PATENTS

| | | | |
|---|---|---|---|
| 3,221,424 | 12/1965 | Hancock | 37/129 |
| 3,274,711 | 9/1966 | Johnson et al. | 37/8 X |
| 3,343,286 | 9/1967 | Ray, Jr. et al. | 37/129 X |
| 3,462,860 | 8/1969 | Hermiz et al. | 37/129 |
| 3,474,548 | 10/1969 | Miller | 37/8 |
| 3,479,758 | 11/1969 | Johnson et al. | 37/129 |
| 3,660,914 | 5/1972 | Bechman et al. | 37/129 |
| 3,732,636 | 5/1973 | Stuller et al. | 37/129 X |
| 3,732,637 | 5/1973 | Whitworth | 37/124 |
| 3,742,628 | 7/1973 | Walser et al. | 37/124 |
| 3,916,545 | 11/1975 | Hochmann et al. | 37/126 AE X |

*Primary Examiner*—E. H. Eickholt
*Attorney, Agent, or Firm*—Edward J. Biskup

[57] ABSTRACT

A scraper bowl having a movable bottom floor section that is supported at each side thereof by a carriage that is actuated by a horizontally oriented hydraulic cylinder mounted on the side wall of the scraper bowl and located forwardly of the floor section.

3 Claims, 3 Drawing Figures

SCRAPER BOWL WITH MOVABLE FLOOR SECTION

This invention concerns an elevating earthmoving scraper and more particularly a scraper bowl for an elevating scraper that has a movable floor section operated by a hydraulic cylinder for opening and closing an opening in the bottom of the scraper bowl through which material can be dumped.

In the preferred form, the scraper bowl made according to the invention has a pair of laterally spaced parallel side walls the forward portions of which are interconnected by a fixed transversely extending cutting blade. The rear portions of the side walls are interconnected by a bottom wall in a manner whereby an opening through which earth material can be ejected is provided between the rear of the cutting blade and the front edge of the bottom wall. The opening in the bottom wall is opened and closed through a movable floor section which is rectangular in configuration, and each side edge of the floor section has a carriage assembly attached thereto that is provided with rollers for supporting the floor section for horizontal movement relative to the side walls along a horizontal track attached to the side wall. More specifically, each carriage assembly has a support plate which is fixedly connected to the associated side edge of the floor section. The support plate has a longitudinal length substantially equal to the length of the associated side edge and is provided with a first roller rotatably mounted on the support plate adjacent to the front edge of the floor section and a second roller rotatably mounted thereon adjacent the rear edge of the floor section. A double-acting hydraulic cylinder is located on the outer surface of each side wall and has one end thereof pivotally connected to the associated side wall at a point located forwardly of the cutting blade and has the other end pivotally connected to the support plate at a point located between the two rollers. In addition, the front edge of the floor section pivotally supports a strike-off blade which at each end has an upstanding projection that extends upwardly therefrom and is adapted to contact a vertically oriented flat surface on a block member carried by a side wall and cause the strike-off blade to be cammed upwardly into a position adjacent the cutting blade so as to close a portion of the bottom opening in the scraper bowl when the floor section is in a closed position.

The objects of the present invention are to provide a new and improved scraper bowl for an elevating scraper that includes a floor section carried by the side walls of the scraper bowl and movable by a horizontally oriented hydraulic cylinder to open and close an opening in the bottom of the scraper bowl; to provide a new and improved scraper bowl having a movable floor section that is supported at each side for sliding movement by a carriage that is connected to a linear actuator pivotally mounted on the side wall of the scraper bowl and located forwardly of the floor section; and to provide a new and improved scraper bowl the bottom of which has a movable floor section which pivotally supports a strike-off blade at the forward edge thereof that is movable by a vertically oriented camming surface to a horizontal position for closing a portion of the opening in the bottom of the scraper bowl; and to provide a new and improved scraper bowl having a movable floor section supported at each side by a carriage having a pair of longitudinally spaced rollers and movable by a hydraulic cylinder one end of which is pivoted to the side wall of the scraper bowl and the other end of which is pivoted to the carriage between the rollers.

Other objects and advantages of the present invention will be more apparent from the following detailed description when taken with the drawings in which.

Figure 1:
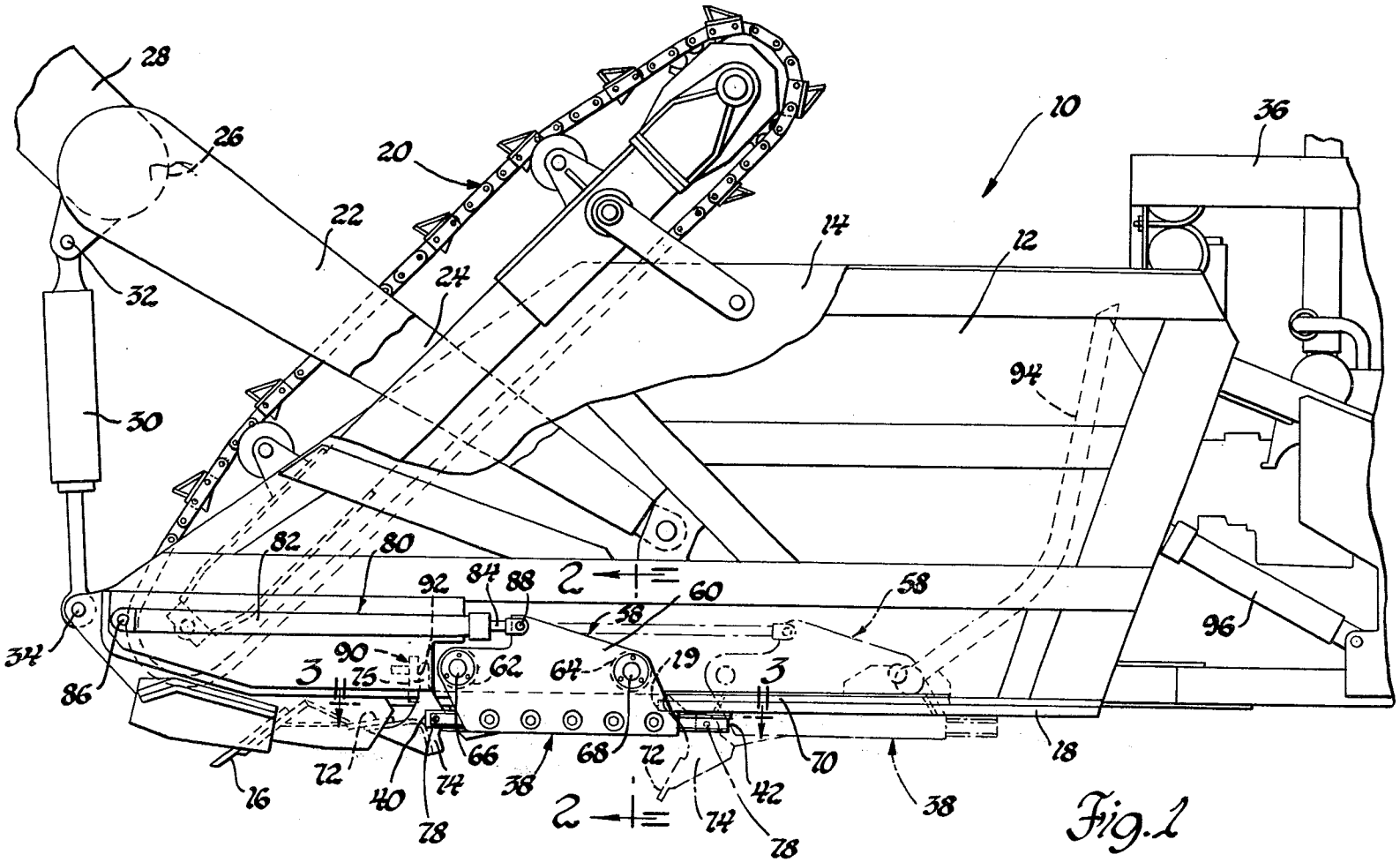
FIG. 1 is an elevational view showing a scraper bowl made according to the invention.

Referring to FIG. 1, a scraper bowl 10, which forms a part of an elevating scraper, is shown comprising a pair of laterally spaced and parallel side walls 12 and 14 which are interconnected at the front and rear lower ends by a transversely extending cutting blade 16 and a flat horizontally oriented bottom wall 18 respectively. The bottom wall 18 terminates with a front edge 19 located approximately midway between the front end and rear end of the side walls. Thus, a rectangular opening exists in the bottom of the scraper bowl that is defined by the side walls 12 and 14, the rear of the cutting blade 16 and the front edge 19 of the bottom wall 18.

As is conventional in elevating scrapers, the forward end of the scraper bowl 10 is open and has an elevating device 20 supported therein which serves to move dirt and other material rearwardly from the cutting blade 16 during a digging operation. In addition, the scraper bowl 10 is supported by a pair of laterally spaced pull arms 22 and 24 the rearward portion of each of which is pivotally connected to the associated side wall of the scraper bowl 10. The forward ends of the pull arms 22 and 24 are fixed with a transverse torque tube 26, which in turn, is connected with a goose neck 28 that extends forwardly for connection in the usual manner, to a tractor (not shown). Each end of the torque tube 26 is provided with a double-acting hydraulic cylinder 30 which has the opposite ends thereof connected by pivotal connections 32 and 34 between the forward portion of the scraper bowl 10 and the torque tube 26. Thus, by expanding the cylinders 30, the scraper bowl 10 is lowered into a digging position while contraction of the cylinders 30 causes the scraper bowl 10 to be raised upwardly into a carry position. Although not shown, the rearward portion of the scraper bowl 10 is supported by the usual wheeled axle which, in this case, is driven through an engine 36 mounted on the rear frame portion of the scraper bowl 10.

Figure 2:
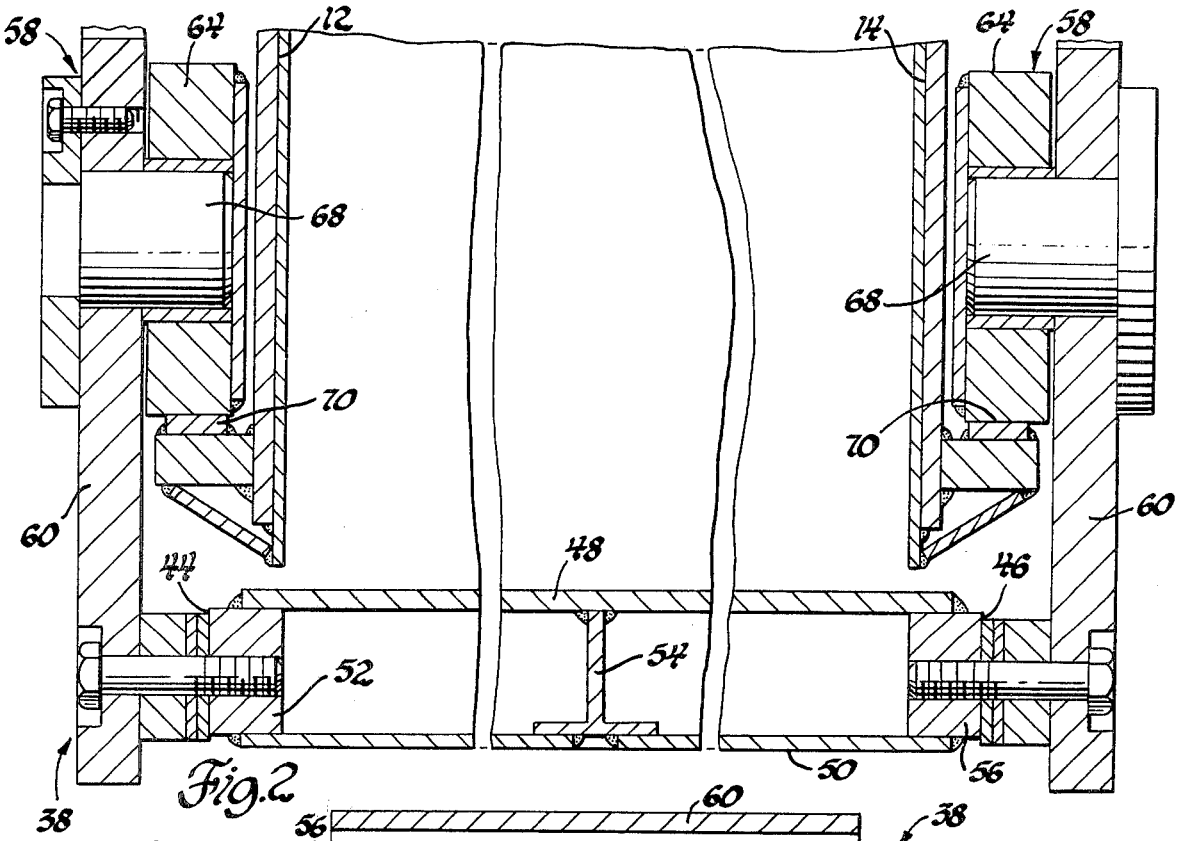
FIG. 2 is an enlarged sectional view of a part of the scraper bowl taken on lines 2—2 of FIG. 1.
Figure 3:
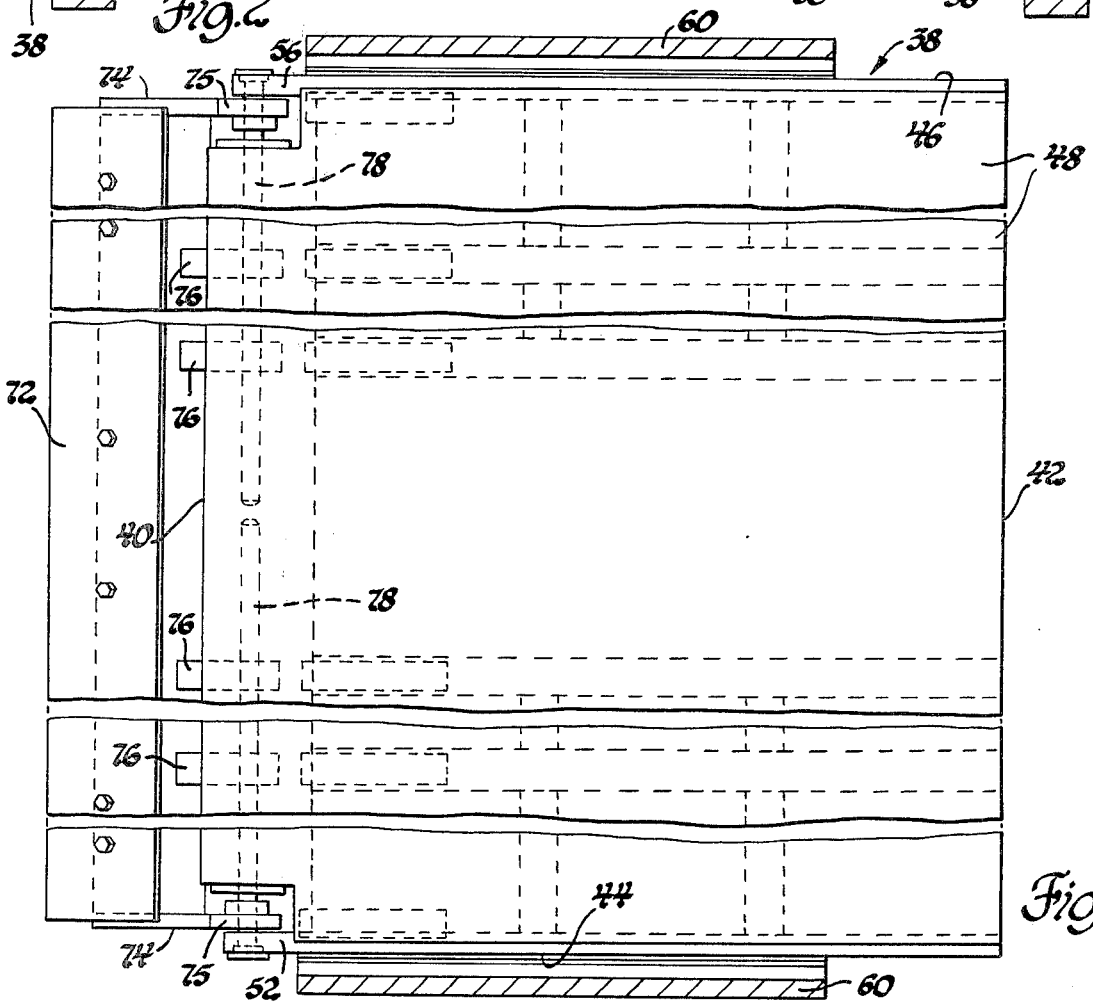
FIG. 3 is an enlarged plan view showing the bottom floor section incorporated with the scraper bowl taken on line 3—3 of FIG. 1.

As aforementioned, the scraper bowl 10 is provided with a rectangular opening between the rear portion of the cutting blade 16 and the front edge 19 of the bottom wall 18. This opening is normally closed by a floor section 38, which, as seen in FIGS. 2 and 3, is substantially the same size as the opening and is also rectangular in configuration and includes a front edge 40, a rear edge 42 and a pair of side edges 44 and 46. The floor section 38 includes a planar body portion composed of vertically spaced flat plate members 48 and 50 that are rigidly interconnected through appropriate structural members such as the elongated bars 52, 54, and 56 located at the sides of and between the plate members as seen in FIG. 2. The body portion of the floor section 38 located at a level below the bottom wall 18 so as to be movable rearwardly from the full line position of FIG. 1 to the phantom line position.

Each side edge 44 and 46 of the floor section 38 is provided with a carriage assembly 58 consisting of a vertically oriented support plate 60 which is fixed at its lower end to the associated side edge of the floor section 38. The support plate 60 has a longitudinal length which is substantially equal to the length of the associated side edge and is provided with a pair of rollers 62 and 64 the former of which is rotatably mounted on a shaft 66 attached to the support plate 60 adjacent the front edge 40 of the floor section 38. The other roller 64 is rotatably mounted on a shaft 68 attached to the support plate 60 adjacent the rear edge 42 of the floor section 38 and each pair of rollers 62 and 64 are adapted to roll along an elongated track 70 which is rigidly secured to the associate side wall.

As best seen in FIGS. 1 and 3, the forward edge 40 of the floor section 38 is provided with a transversely extending strike-off blade 72 the opposite ends of which are rigidly secured to a L-shaped bracket 74 one leg 75 of which serves as a projection extending upwardly for reasons which will be explained hereinafter. The brackets 74 together with laterally spaced inner brackets 76 serve to pivotally mount the strike-off blade 72 to a pair of transverse shafts 78 fixed to the body portion of the floor section 38.

Each side wall of the scraper bowl 10 carries a double-acting hydraulic cylinder 80 the longitudinal axis of which is located along a substantially horizontal plane. Each cylinder 80 consists of a relatively movable cylinder member 82 and piston member 84. The base end of the cylinder member 82 is connected by a pivotal connection 86 to the side wall at a point forwardly of the cutting blade 16. The rod portion of the piston member 84 is connected by a pivotal connection 88 to the upper part of the support plate 60 at a point located between the rollers 62 and 64 so that the loading on the rollers tends to be equalized. In addition, located below the cylinder 80 is a block member 90 which is secured to the inner surface of each side wall and includes a flat surface 92 which lies in a substantially vertical plane.

Thus, from the above description it should be apparent that the floor section 38 serves to close the opening in the bottom of the scraper bowl 10 when located in the full line position as seen in FIG. 1. In operation after the scraper bowl 10 is filled with material and the scraper is driven to a dump site, each hydraulic cylinder 80 mounted on each side wall of the scraper bowl 10 is expanded so as to cause the carriage assembly 58 and the attached body portion of the floor section 38 to move rearwardly from the full line position to the dotted line position seen in FIG. 1. As alluded to hereinbefore, the body portion of the floor section 38 is located in a plane that is below the bottom wall 18 so that there is no interference with the latter during the opening and closing operation. When the floor section 38 moves to the open position, the strike-off blade 72 pivots downwardly by gravity about the transverse shafts 78 into the dotted line position shown in FIG. 1.

The floor section 38 is returned to the full line or closed position by contracting the hydraulic cylinder 80 so as to cause the floor section 38 to move towards the left as seen in FIG. 1. During this movement, the leg or projection 75 of bracket 74 contacts the flat surface 92 on the block member 90 and causes the strike-off blade 72 to be pivoted upwardly into a position adjacent to the cutting blade 16 so as to completely close the opening in the bottom of the scraper bowl 10. As is conventional, an ejector plate 94 is located in the rear of the scraper bowl 10 and is movable forwardly through a hydraulic cylinder 96 for completing the dumping of the material out of the bottom of the scraper bowl. Thus, both the floor section 38 and the ejector plate 94 cooperate for ejecting all of the material out of the scraper bowl 10.

Various changes and modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In a scraper bowl having a pair of parallel spaced side walls the forward portions of which are interconnected by a fixed transversely extending cutting blade and the rearward portions of which are interconnected by a bottom wall in a manner whereby an opening through which earth material can be dumped is provided between the rear of the cutting blade and the front of the bottom wall, a movable floor section for normally closing said opening, said floor section being rectangular in configuration and including a front edge, a rear edge and a pair of side edges, each of said side walls rigidly supporting an elongated track, each side edge having a carriage assembly attached thereto for supporting the floor section for movement relative to the side walls along one of the tracks, each carriage assembly comprising a support plate fixedly connected to the associated side edge, a first roller and a second roller rotatably mounted on the support plate, a double-acting hydraulic cylinder on each side wall for moving the floor section between a first position wherein said floor section closes said opening and a second position wherein said floor section exposes said opening, a first pivot connection for connecting one end of said hydraulic cylinder to the associated side wall at a point located adjacent to the cutting blade, a second pivot connection for connecting the other end of the hydraulic cylinder to the support plate at a point located between said first and second rollers, a strike-off blade having a projection extending upwardly therefrom, means pivotally connecting said strike-off blade at the front edge of the floor section, and a block member secured to each side wall and having a flat surface horizontally aligned with the projection on said strike-off blade whereby movement of the floor section from the second position to the first position causes said projection to contact said flat surface and cam the strike-off blade upwardly into a position adjacent to the cutting blade so as to completely close said opening.

2. In a scraper bowl having a pair of parallel spaced side walls the forward portions of which are interconnected by a fixed transversely extending cutting blade and the rearward portions of which are interconnected by a bottom wall in a manner whereby an opening through which earth material can be dumped is provided between the rear of the cutting blade and the front of the bottom wall, a movable floor section for normally closing said opening, said floor section being rectangular in configuration and including a front edge, a rear edge and a pair of side edges, each of said side walls rigidly supporting a horizontal track, each side edge having a carriage assembly attached thereto for supporting the floor section for movement relative to the side walls along one of the tracks, each carriage assembly comprising a support plate fixedly connected to the associated side edge and having a longitudinal length substantially equal to the length of said associated side edge, a first roller rotatably mounted on the support plate adjacent the front edge of the floor section, a second roller rotatably mounted on the support plate adjacent the rear edge of the floor section, a double-acting hydraulic cylinder on each side wall for moving the floor section between a first position wherein said floor section closes said opening and a second position wherein said floor section exposes said opening, a first pivot connection for connecting one end of said hydraulic cylinder to the associated side wall at a point located adjacent to the cutting blade, a second pivot connection for connecting the other end of the hydraulic cylinder to the support plate at a point located between said first and second rollers, a strike-off blade having a projection extending upwardly therefrom, means pivotally connecting said strike-off blade to the front edge of the floor section, and a block member secured to each side wall and having a flat surface lying in a substantially vertical plane and horizontally aligned with the projection on said strike-off blade whereby movement of the floor section from the second position to the first position causes said projection to contact said flat surface and cam the strike-off blade upwardly into a position adjacent to the cutting blade so as to completely close said opening.

3. In a scraper bowl having a pair of parallel spaced side walls the forward portions of which are interconnected by a fixed transversely extending cutting blade and the rearward portions of which are interconnected by a bottom wall in a manner whereby an opening through which earth material can be dumped is provided between the rear of the cutting blade and the front of the bottom wall, a movable floor section for normally closing said opening, said floor section having a planar body portion that is rectangular in configuration and includes a front edge, a rear edge and a pair of side edges, each of said side walls rigidly supporting a horizontal track, each side edge having a carriage assembly attached thereto for supporting said body portion for movement relative to the side walls along one of the tracks, each carriage assembly comprising an upstanding support plate fixedly connected at its lower end to the associated side edge and having a longitudinal length substantially equal to the length of said associated side edge, a first roller rotatably mounted on the support plate adjacent the front edge of the floor section, a second roller rotatably mounted on the support plate adjacent the rear edge of the floor section, a double-acting hydraulic cylinder on each side wall for moving the floor section between a first position wherein said floor section closes said opening and a second position wherein said floor section exposes said opening, a first pivot connection for connecting one end of said hydraulic cylinder to the associated side wall at a point located forwardly of the cutting blade, a second pivot connection for connecting the other end of the hydraulic cylinder to the support plate at a point located between said first and second rollers, a strike-off blade having one end thereof provided with an L-shaped bracket, one leg of said bracket extending upwardly therefrom, means pivotally connecting said strike-off blade to the front edge of the floor section, and a block member secured to each side wall and having a flat surface lying in a substantially vertical plane and horizontally aligned with said one leg of said bracket whereby movement of the floor section from the second position to the first position causes said one leg to contact said flat surface and cam the strike-off blade upwardly into a position adjacent to the cutting blade so as to completely close said opening.

* * * * *